US007748338B2

(12) United States Patent
Chia et al.

(10) Patent No.: US 7,748,338 B2
(45) Date of Patent: Jul. 6, 2010

(54) METHOD OF INTERCEPTING AND YAWING A SAILING VESSEL

(75) Inventors: Hock Thye Chia, Singapore (SG); Saik Hay Fong, Singapore (SG); Hong Soon Tan, Singapore (SG); Tee Peng Toh, Singapore (SG)

(73) Assignee: Singapore Technologies Dynamics Pte Ltd., Singapore (SG)

( * ) Notice: Subject to any disclaimer, the term of this patent is extended or adjusted under 35 U.S.C. 154(b) by 2 days.

(21) Appl. No.: 12/087,225

(22) PCT Filed: Dec. 28, 2006

(86) PCT No.: PCT/SG2006/000407

§ 371 (c)(1),
(2), (4) Date: Sep. 29, 2008

(87) PCT Pub. No.: WO2007/078260

PCT Pub. Date: Jul. 12, 2007

(65) Prior Publication Data

US 2009/0020062 A1 Jan. 22, 2009

(30) Foreign Application Priority Data

Dec. 30, 2005 (SG) ..... 200508616-0

(51) Int. Cl.
*B63B 35/68* (2006.01)

(52) U.S. Cl. ..... 114/253; 114/249

(58) Field of Classification Search ..... 114/246, 114/248, 249, 251, 253, 245, 254
See application file for complete search history.

(56) References Cited

U.S. PATENT DOCUMENTS 1,286,048 A * 11/1918 Mason ..... 114/253
2,902,966 A * 9/1959 Wolfgang ..... 114/253

(Continued)

FOREIGN PATENT DOCUMENTS

FR 2434752 3/1980

(Continued)

OTHER PUBLICATIONS

International Search Report dated Apr. 4, 2007 based on PCT application No. PCT/SG2006/000407.

*Primary Examiner*—Lars A Olson
(74) *Attorney, Agent, or Firm*—Ohlandt, Greeley, Ruggiero & Perle, L.L.P.

(57) ABSTRACT

A method for intercepting and yawing an errant sailing vessel is disclosed, wherein the vessel might have been hijacked or malfunctioned and in danger of colliding with an object. The method comprises dispatching a pair of watercraft to approach said sailing vessel, providing a tow rope to be secured at one end to first watercraft and the other end to second watercraft. The tow rope is brought to extend between the first and second watercrafts over the hull of said sailing vessel. The first watercraft is then secured to one side of said sailing vessel's hull, while second watercraft pulls the tow rope away from the direction of sailing on the other side of said vessel's hull. In an alternative embodiment, the tow rope end held by the first watercraft may be secured directly to the vessel's hull, thus freeing the first watercraft to evacuate crew from the vessel to a safer distance.

16 Claims, 2 Drawing Sheets

U.S. PATENT DOCUMENTS

Figure 1:
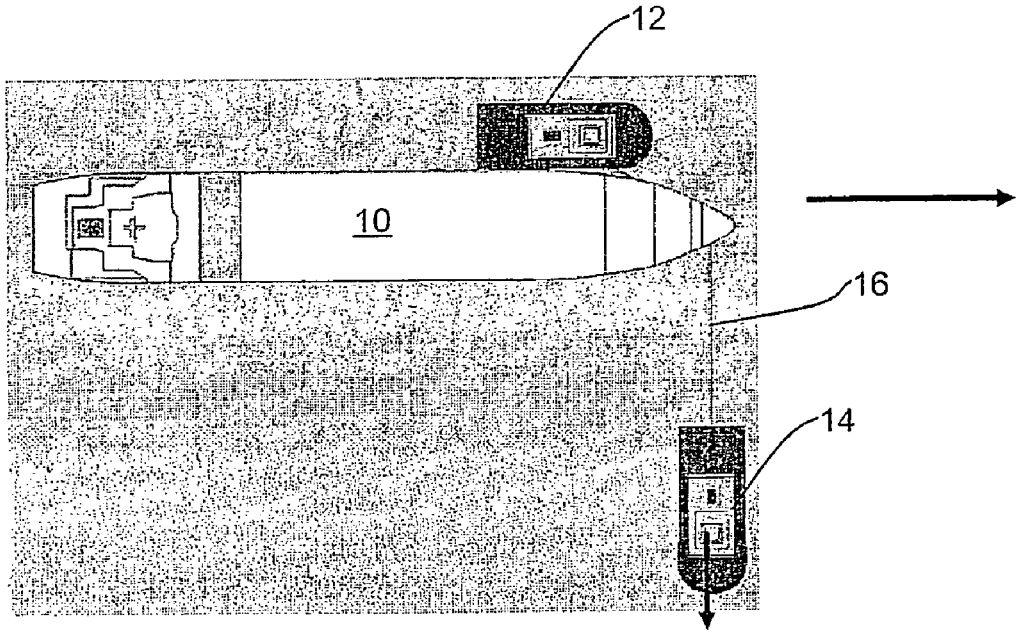

| | | | | |
|---|---|---|---|---|
| 3,336,895 | A * | 8/1967 | Nelson | 114/246 |
| 3,745,958 | A * | 7/1973 | Nelson | 114/246 |
| 4,449,471 | A * | 5/1984 | van Roon | 114/249 |
| 5,575,230 | A * | 11/1996 | Eronen | 114/253 |
| 6,325,015 | B1 | 12/2001 | Garcia et al. | 114/382 |
| 6,413,128 | B2 | 7/2002 | Brabeck | 440/66 |
| 6,591,774 | B2 | 7/2003 | Metherell et al. | 114/241 |
| 6,698,374 | B1 | 3/2004 | Van Der Laan | 114/253 |

FOREIGN PATENT DOCUMENTS

| | | |
|---|---|---|
| GB | 2034641 | 6/1980 |
| WO | WO2005/118390 | 12/2005 |

* cited by examiner

METHOD OF INTERCEPTING AND YAWING A SAILING VESSEL

TECHNICAL FIELD

This invention relates to a method of intercepting a sailing vessel and yawing it to force a change in direction of sail. It is directed to regaining control of sail direction of an errant or malfunctioned vessel.

BACKGROUND ART

In post-Sep. 11, 2001 terrorist attacks on New York City which has heightened fears of man-made disasters and terrorist acts, it has been envisaged that ships and large vessels may be used to attack and destroy harbours and seafront installations such as oil refineries, chemical plants, etc. or another sea-borne object such as oil rig or a passenger ship. As some of the ships and vessels may be carrying flammable or inflammable materials, such as crude oil or refined petroleum products, they might be hijacked by terrorists and set on course to collide with these targets of attack. If the vessel is large enough, its massive moving mass may create a momentum large enough to cause destruction by sheer collision onto a target.

Accordingly, it is imperative that methods are available for preventing such attacks and that the errant or malfunctioning vessel be quickly controlled and yawed to avoid colliding with the targets or being used as a weapon of massive destruction.

U.S. Pat. No. 6,591,774 discloses a barrier system for protecting ships and harbours from attack by vessels. The barrier system is constructed around the ships or habour to be defended. The barrier may either be floating on the surface above and/or beneath the surface of the water. When a vessel attempts to force its way through the barrier, the barrier uses the momentum of the vessel against itself by using the forward momentum of the attacking vessel in such a manner as to divert, impede, stop, damage or destroy the vessel. This system however may only be suitable for stopping a small attacking vessel and may not be suitable for arresting large shipping vessels.

U.S. Pat. No. 6,413,128 discloses a device for changing the direction of travel of a watercraft. The device includes a gondola-like underwater housing having a container favourable in terms of flow outside the hull by the watercraft, and is connected to the hull of the watercraft by a shaft. The change in direction of travel of the watercraft is brought about by a pivoting motor acting on the shaft, and the use of high energy fluid jets in the gondola-like structure. The latter is a permanent device attached to the watercraft to enhance steering at low noise.

U.S. Pat. No. 6,698,374 discloses a tugboat design with a towing installation having a 360° turning to steer and guide a large shipping vessel. There is no disclosure on means of attaching the tow rope to a vessel to be towed, especially a large vessel such as a hijacked one, as access to the vessel would be denied.

It is therefore desirable that a method be provided to effectively intercept an errant or malfunctioned vessel from crashing into a seaside installation or sea-borne target of terrorist attacks or mishaps resulting from vessel malfunction.

Any discussion of documents, devices, acts or knowledge in this specification is included to explain the context of the invention. It should not be taken as an admission that any of the material forms a part of the prior art base or the common general knowledge in the relevant art in Singapore or elsewhere on or before the priority date of the disclosure and claims herein. All statements as to the date or representation as to the contents of these documents is based on the information available to the applicant and does not constitute any admission as to the correctness of the dates or contents of these documents.

SUMMARY OF DISCLOSURE

In accordance with the above objects, a method is provided herein for intercepting and yawing a sailing vessel comprising the steps of despatching at least a pair of watercraft to approach said sailing vessel; providing a tow rope to be secured at one end to first watercraft and the other end to second watercraft; bringing the tow rope extending between said first and second watercrafts over the hull of said sailing vessel; and securing first watercraft to one side of said sailing vessel's hull, while second watercraft pulls the tow rope away from the direction of sailing on the other side of said vessel's hull.

In one embodiment of the method, the tow rope is extended along the vessel's bow, the first watercraft is secured to one side of the vessel's hull opposing the direction of yawing and the second watercraft pulls the tow rope in the direction of yawing on the other side of the vessel's hull.

In another embodiment, the tow rope is extended along the vessel's stern, the first watercraft is secured to one side of the vessel's hull to the direction of yawing and the second watercraft pulls the tow rope in the opposite direction of yawing on the other side of the vessel's hull.

In a preferred embodiment, the tow rope is extended from about 80 to 140 m in length between said first and second watercrafts. Preferably, the tow rope is substantially buoyant, including at least one or combination of relying on said tow rope material's natural buoyancy and providing floats attachable to said tow rope.

In another preferred embodiment, once the sailing vessel is determined to be yawed to a direction on one side of said vessel's hull, a first watercraft on the other side of said hull is secured to said hull, a second watercraft on the side of the hull to be yawed pulls said tow rope away from the vessel's direction of sailing. Preferably, the first watercraft is secured to the side of sailing vessel's hull by temporary releasable attachment means, which may include any one or combination of electromagnetic means; vacuum suction means; and/or mechanical clamping or hook means.

In still another preferred embodiment, the first watercraft employs fast acting securing means to secure said first watercraft to the hull in a permanent or secure manner, including employing explosive-propelled hull-piercing mechanical clamping means; and hull-drilling with mechanical clamping means. Preferably, the permanent securing means are used to secure the end of said tow rope to the side of the sailing vessel's hull. This enables the first watercraft to undertake rescue operations and frees itself from said sailing vessel being yawed by second watercraft.

Another aspect of our method for intercepting and yawing a sailing vessel comprising the steps of despatching at least a pair of watercrafts to approach said sailing vessel, providing a tow rope to be secured at one end to first watercraft and the other end to second watercraft; securing first watercraft to one side of said sailing vessel's hull, while second watercraft pulls said first watercraft with the tow rope on the same side of sailing vessel's hull. The tow rope, the first watercraft's mode of operation and means for securing to the vessel's hull may have similar features as described above.

These and other advantages of our invention may be better understood with reference to the accompanying drawings and the detailed description in the following.

Other aspects and preferred aspects are disclosed in the specification and/or defined in the appended claims, forming a part of the description of the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

LIST OF ACCOMPANYING DRAWINGS

Figure 2:
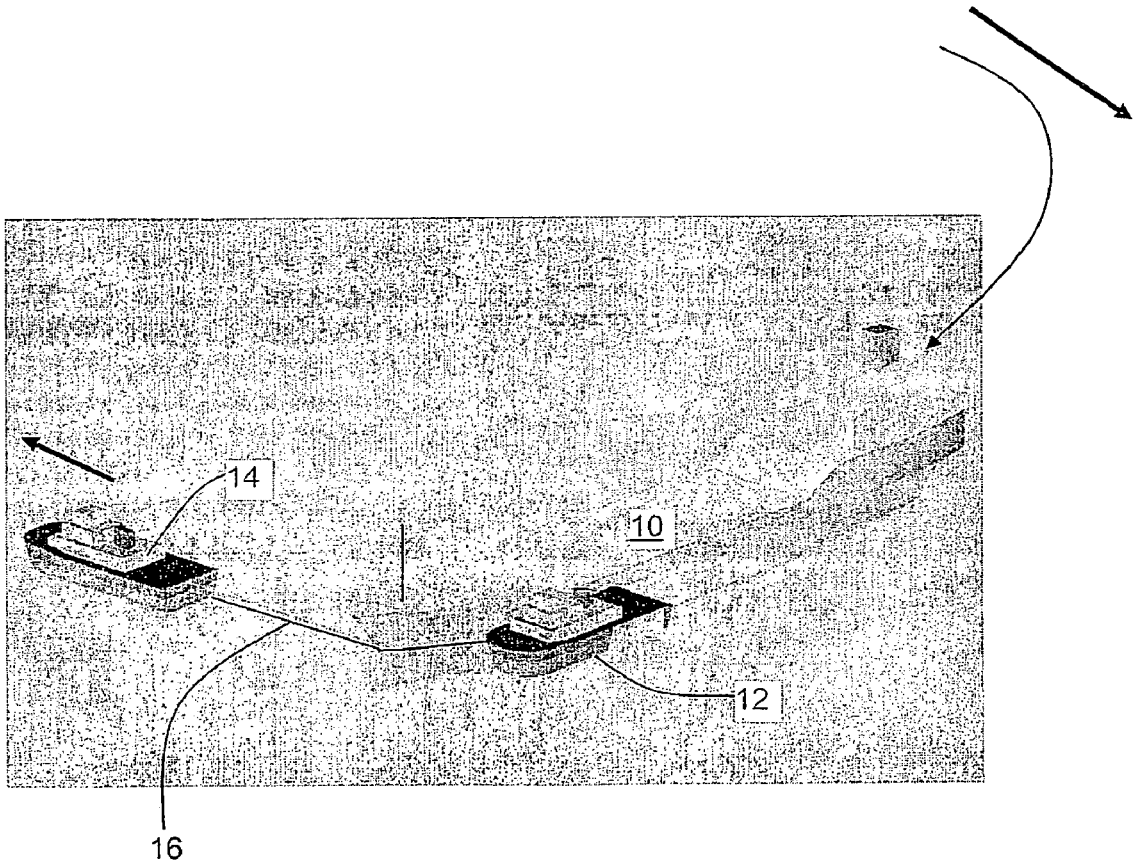

The present invention will now be described in detail with reference to the accompanying drawings that follows, wherein specific embodiments are described as non-limiting examples or illustrations of the workings of the invention, in which:

FIG. 1 shows a plan view of our method being executed by 2 watercrafts on an errant sailing vessel; and FIG. 2 shows a perspective schematic view of our method in which the errant sailing vessel is shown to have been yawed away from its original direction of sail.

DETAILED DESCRIPTION OF SPECIFIC EMBODIMENTS

The general embodiment of our method for intercepting and yawing a sailing vessel may be described as firstly, despatching at least a pair of watercraft to approach said sailing vessel, providing a tow rope to be secured at one end to first watercraft and the other end to second watercraft, bringing the tow rope extending between said first and second watercrafts over the hull of said sailing vessel, and securing first watercraft to one side of said sailing vessel's hull, leaving second watercraft to pull the tow rope away from the direction of sailing on the other side of said vessel's hull.

FIG. 1 shows, in plan view, a schematic view of our method in which an errant sailing vessel (10) is shown being intercepted and yawed by a pair of watercrafts (12, 14) according to our invention. Upon detecting or receiving report of an errant vessel, two or more of such watercrafts (12, 14) may be quickly despatched to approach the vessel (10). While the watercrafts (12, 14) are positioned ahead of the vessel (10), a tow rope (16) may be extended from one of the watercraft; for example, from first watercraft (12) to second watercraft (14) so that each watercraft secures respective ends of the tow rope (16).

The pair of watercrafts (12, 14) may then hold the two rope (16) across the path of the vessel so that the tow rope (16) may be brought to extend between said first and second watercrafts (12, 14) so that the rope may be caught over the bow of said sailing vessel as it approaches the extended tow rope (16) held between the two watercrafts (12, 14).

Depending on the size of the vessel to be intercepted and yawed and the location of operation, the tow rope may be extended to an appropriate length. For a typical vessel, about 80 to 140 m in length held between the two watercrafts (12, 14) may be a sufficient length for tugging the vessel's bow. Accordingly, it will be advantageous for the tow rope to float on the water. For this purpose, the natural jute fibre of the rope may be relied upon for buoyancy. Alternatively, where steel chains are used, floats may be attached to the chain to enable it to float on the water surface.

The direction of the vessel to be altered or yawed may be predetermined since it is envisaged that a large turning radius is required due to the momentum of the vessel. The next step of the operation will depend on whether the vessel is to be yawed towards its portside (leftward) or starboard (rightward). The first watercraft may then be secured to one side of the vessel's hull, while the second watercraft pulls the tow rope away from the direction of sailing on the other side of said vessel's hull. In other words, as shown in FIG. 1, if it is decided that the vessel (10) should be yawed towards its starboard, then the first watercraft (12) would secure itself to the portside of the hull, while the second watercraft (14) moves to tow the rope away from the original direction of sail, i.e. rightward of the vessel.

Alternatively, if the vessel is to be yawed to the left, the first watercraft would attach itself to the starboard and the second watercraft pull the tow rope leftward of the vessel.

The first watercraft (12) may be secured to the side of the sailing vessel's (10) hull by a suitable temporary releasable attaching means including any one or in combination of electromagnetic means (such as a solenoid bank), vacuum suction means; and mechanical clamping or hook means. A number of such attaching means are disclosed in our co-pending International Patent Application No. PCT/SG2005/000178 filed on 3 Jun. 2005 which disclosure is incorporated herein by reference.

The first watercraft's temporary attaching means may be used advantageously to quickly secure the watercraft (12) to the vessel's hull while a more secure or permanent attaching means is being put in place. Such secure attaching means may include explosive-propelled hull-piercing mechanical clamping means (e.g. explosive-activated mechanical bolt) and hull-drilling with mechanical clamping means.

Preferably, once the permanent securing means are successfully deployed, the end of the tow rope (16) may be attached to the permanent securing means so that the tow rope (16) end is now secured directly to the side of the vessel hull. This will release the first watercraft (12) from the need to be attached to the side of the hull as an anchor to the vessel for the second watercraft (14) to tug along. The first watercraft may then be freed to undertake rescue operations such as storming and evacuating the crew of the errant vessel, and to move away from the vessel to a safer distance.

FIG. 2 shows in perspective view the preferred arrangement of the watercrafts' deployment in respect of yawing the vessel from its original direction of sail. It is estimated that a vessel of 276 m long, 40 m wide with a design draft of 12 m and displacement of 73,000 metric tons travelling at 15 knots, a tow rope of 200 ton strength positioned at the bow of the vessel and aligned at 90° to the direction of travel would be sufficient to yaw the vessel with a turning radius of 2 km. The errant vessel can thus be manoeuvred or diverted to a safe zone for further action.

It will be appreciated that a number of the above-described features of our invention may be adopted modularly, modified, reconfigured, or alternatively adapted which are still based on the same general concept, features and working principles of the present invention. For example, the method may be adapted for use at the stern of the errant vessel instead of at the bow, in which case the pair of watercraft will have to adopt the "chase" method, i.e. the need to be faster than the vessel. The roles of each of the watercrafts are also reversed, i.e. the watercraft to be secured to side of the hull will be on the same side as the direction to be yawed, while the watercraft on the other side of the hull will pull.

Another possible variation is to have both the first and second watercrafts on the same side of the vessel with direction it is to be yawed. As with the previous methods, the first watercraft attaches to the errant vessel while the second watercraft pulls at the first watercraft on the same side of the vessel in the same direction of yawing, i.e. without the tow rope being wrapped around the bow or stern of the vessel.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

"Comprises/comprising" when used in this specification is taken to specify the presence of stated features, integers, steps or components but does not preclude the presence or addition of one or more other features, integers, steps, components or groups thereof."

We claim:

1. A method for intercepting and yawing a sailing vessel comprising the steps of:

(a) despatching at least a first watercraft and a second watercraft to approach said sailing vessel moving in a direction of sailing;

(b) providing a tow rope to be secured at one end to said first watercraft and the other end to said second watercraft;

(c) bringing the tow rope extending between said first and second watercrafts over one end of a sailing vessel's hull of said sailing vessel; and (d) securing said first watercraft to one side of said sailing vessel's hull, while said second watercraft pulls the tow rope away from the direction of sailing over to the other side of said sailing vessel's hull.

2. A method according to claim 1 wherein the tow rope is extended along a vessel's bow of said sailing vessel, the first watercraft is secured to said one side of the sailing vessel's hull opposing a direction of yawing of said sailing vessel and the second watercraft pulls the tow rope in the direction of yawing on the other side of the sailing vessel's hull.

3. A method according to claim 1 wherein the tow rope is extended along a vessel's stern of said sailing vessel, the first watercraft is secured to said one side of the sailing vessel's hull on a side facing a direction of yawing of said sailing vessel and the second watercraft pulls the tow rope in an opposite direction of yawing on the other side of the sailing vessel's hull.

4. A method according to claim 1 wherein the tow rope is extended from about 80 to 140 m in length between said first and second watercrafts.

5. A method according to claim 2 wherein the tow rope is substantially buoyant by, at least one or combination of:

relying on a natural buoyancy of a material of said tow rope; and providing floats attachable to said tow rope.

6. A method according to claim 1 wherein the first watercraft is secured to the side of said sailing vessel's hull by temporary releasable attachment means including any one or combination of:

electromagnetic means;

vacuum suction means;

mechanical clamping or hook means.

7. A method according to claim 6 wherein the first watercraft employs securing means to secure said first watercraft to the sailing vessel's hull in a permanent or secure manner, including employing explosive-propelled hull-piercing mechanical clamping means;

hull-drilling with mechanical clamping means.

8. A method according to claim 7 wherein the permanent securing means are used to secure the end of said tow rope directly to the side of the sailing vessel's hull.

9. A method according to claim 8 wherein said first watercraft undertakes rescue operations and frees itself from said sailing vessel being yawed by second watercraft.

10. A method for intercepting and yawing a sailing vessel comprising the steps of:

(a) despatching at least a pair of watercrafts to approach said sailing vessel;

(b) providing a tow rope to be secured at one end to first watercraft and the other end to second watercraft;

(c) securing first watercraft to one side of said sailing vessel's hull, while second watercraft pulls said first watercraft with the tow rope on the same side of sailing vessel's hull.

11. A method according to claim 10 wherein the tow rope is extended from about 80 to 140 m in length between said first and second watercrafts.

12. A method according to claim 10 wherein the tow rope is substantially buoyant by, at least one or combination of:

relying on said tow rope material's natural buoyancy; and providing floats attachable to said tow rope.

13. A method according to claim 10 wherein the first watercraft is secured to the side of said sailing vessel's hull by temporary releasable attachment means including any one or combination of:

electromagnetic means;

vacuum suction means;

mechanical clamping or hook means.

14. A method according to claim 13 wherein the first watercraft employs securing means to secure said first watercraft to the sailing vessel's hull in a permanent or secure manner, including employing explosive-propelled hull-piercing mechanical clamping means;

hull-drilling with mechanical clamping means.

15. A method according to claim 14 wherein the permanent securing means are used to secure the end of said tow rope directly to the side of the sailing vessel's hull.

16. A method according to claim 15 wherein said first watercraft undertakes rescue operations and frees itself from said sailing vessel being yawed by second watercraft.

* * * * *